US010217555B2

(12) United States Patent
Sun et al.

(10) Patent No.: US 10,217,555 B2
(45) Date of Patent: Feb. 26, 2019

(54) COMPACT INDUCTOR

(71) Applicant: Rockwell Automation Technologies, Inc., Mayfield Heights, OH (US)

(72) Inventors: Xikai Sun, Shanghai (CN); Wei Qian, Shanghai (CN); Shaofeng Zhang, Shanghai (CN); Haihui Lu, Shanghai (CN); Lixiang Wei, Mequon, WI (US); Yuan Xiao, Kitchener (CA); Jiangang Hu, Mequon, WI (US); Richard A. Lukaszewski, New Berlin, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 544 days.

(21) Appl. No.: 14/972,588

(22) Filed: Dec. 17, 2015

(65) Prior Publication Data

US 2017/0178782 A1 Jun. 22, 2017

(51) Int. Cl.

| | |
|---|---|
| ***H01F 27/28*** | (2006.01) |
| ***H01F 27/08*** | (2006.01) |
| ***H01F 3/10*** | (2006.01) |
| ***H01F 27/30*** | (2006.01) |

(52) U.S. Cl.

CPC ..... *H01F 27/085* (2013.01); *H01F 3/10* (2013.01); *H01F 27/306* (2013.01)

(58) Field of Classification Search

CPC ..... H01F 5/00; H01F 27/28; H01F 27/085; H01F 27/2823

USPC ..... 336/200, 232

See application file for complete search history.

(56) References Cited

U.S. PATENT DOCUMENTS

| | | | | |
|---|---|---|---|---|
| 4,959,631 | A * | 9/1990 | Hasegawa | H01F 17/0006 336/180 |
| 5,353,001 | A | 10/1994 | Meinel et al. | |
| 6,392,525 | B1 * | 5/2002 | Kato | H01F 3/08 336/200 |
| 6,917,271 | B2 | 7/2005 | Zhang et al. | |
| 7,432,793 | B2 | 10/2008 | Nussbaum | |
| 7,768,373 | B2 | 8/2010 | Shudarek | |
| 7,920,039 | B2 * | 4/2011 | Shabany | H01F 27/22 336/200 |
| 7,994,888 | B2 * | 8/2011 | Ikriannikov | H01F 3/08 336/200 |
| 9,490,058 | B1 * | 11/2016 | Kluska | H01F 27/22 |
| 2012/0032758 | A1 * | 2/2012 | Mori | H01F 17/0013 333/185 |

(Continued)

FOREIGN PATENT DOCUMENTS

JP 2009105164 A * 5/2009

*Primary Examiner* — Tszfung J Chan
(74) *Attorney, Agent, or Firm* — Kunzler, PC

(57) ABSTRACT

For reducing volume requirements and magnetic flux leakage, a compact inductor includes a first planar core with a first core thickness along a first axis orthogonal to a plane of the first planar core. In addition, the inductor includes a second planar core disposed parallel to the first planar core with a second core thickness along the first axis. The inductor further includes a plurality of electrical windings disposed between and adjacent to an inside plane of the first planar core and an inside plane of the second planar core. The electrical windings may include insulated electrical wires. No magnetic teeth may be disposed between the first planar core and the second planar core. The first axis is parallel to a magnetic axis of each electrical winding.

20 Claims, 19 Drawing Sheets

(56) References Cited

U.S. PATENT DOCUMENTS

2012/0286917 A1* 11/2012 Uchida ..... H01F 17/0013
336/200

* cited by examiner

COMPACT INDUCTOR

FIELD

The subject matter disclosed herein relates to inductors and more particularly relates to a compact inductor.

BACKGROUND INFORMATION

Inductors are widely used electrical components.

BRIEF DESCRIPTION

Inductors are commonly used in electrical devices and are often included in power supplies. Because inductors generate magnetic flux and/or electromagnetic radiation, inductors must often be physically separated from other components in a chassis. In addition, the magnetic flux generated by an inductor often makes it difficult to cool the inductor using passive means such as cooling fins. A compact inductor is disclosed that reduces the leakage of magnetic flux and electromagnetic radiation so that the inductor may be disposed within a smaller volume. In addition, the inductor may support the use of passive cooling, further reducing the operating costs of employing the inductor.

The inductor includes a first planar core with a first core thickness along a first axis orthogonal to a plane of the first planar core. In addition, the inductor includes a second planar core disposed parallel to the first planar core with a second core thickness along the first axis. The inductor further includes a plurality of electrical windings disposed between and adjacent to an inside plane of the first planar core and an inside plane of the second planar core. The electrical windings may include insulated electrical wires. No magnetic teeth may be disposed between the first planar core and the second planar core. The first axis is parallel to a magnetic axis of each electrical winding. A system and method also perform the functions of the inductor.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1:
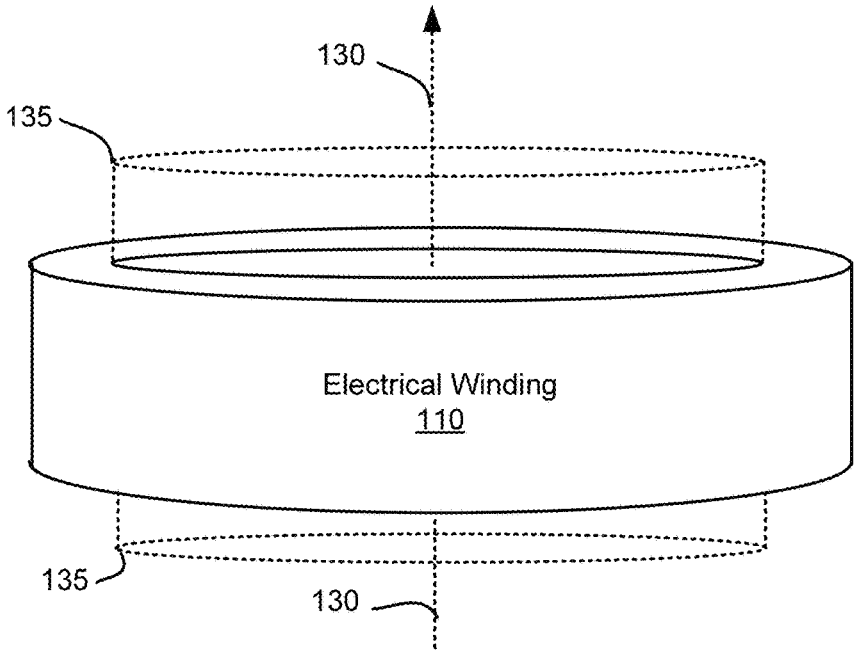
FIG. 1 is a schematic block diagram illustrating one embodiment of an electrical winding.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The schematic flowchart diagrams and/or schematic block diagrams in the Figures illustrate the architecture, functionality, and operation of possible implementations. It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Although various arrow types and line types may be employed in the flowchart and/or block diagrams, they are understood not to limit the scope of the corresponding embodiments. Indeed, some arrows or other connectors may be used to indicate only an exemplary logical flow of the depicted embodiment.

The description of elements in each figure may refer to elements of proceeding figures. Like numbers refer to like elements in all figures, including alternate embodiments of like elements.

Inductors are electrical components that are often used in electrical circuits. Inductors generate a magnetic field that opposes a change in current, and are often used in power supplies and for power conditioning functions. An inductor typically includes one or more coils of electrical windings. The electrical windings may be disposed around a core. Unfortunately, the design of inductors in the past has frequently resulted in significant magnetic flux linkage, electromagnetic radiation leakage, and heat generation. As a result, inductors must often be isolated within a chassis to prevent the magnetic flux leakage, electromagnetic radiation leakage, and heat from affecting other components. This has significantly increased the cost and size of the electrical devices that include power supplies and other electrical circuits that utilize inductors.

The embodiments described herein provides an inductor that reduces magnetic flux leakage and electromagnetic radiation leakage by disposing the electrical windings between a first and second planar core as will be described hereafter. The planar cores limit the leakage of magnetic flux and electromagnetic radiation. In addition, the planar cores support efficient cooling of the inductor. As a result, the inductor requires less buffer space within an electrical chassis, reducing the cost of electrical equipment.

The topologies of traditional inductor designs are also not conducive to the use of common mode inductance. Typically, common mode inductors are added in series with differential mode inductors. However, the use of two separate inductors increases the cost and the volume required to provide an inductor with common mode inductance.

The embodiments described herein provide an inductor that integrates common mode windings with differential mode electrical windings. As a result, integrated differential mode and common mode inductance is provided within a smaller volume and at a reduced cost.

FIG. 1 is a schematic block diagram illustrating one embodiment of an electrical winding 110. The electrical winding 110 may comprise one or more turns of insulated electrical conductor such as electrical wire. When an electrical current is applied to the electrical winding 110, the electrical winding 135 generates a magnetic field. The magnetic field has a magnetic axis 130. In addition, a magnetic axis region 135 may be defined within the electrical winding 110. Although magnetic flux may extend all around the electrical windings 110, as used herein, the magnetic axis region 135 is bounded by an interior of the electrical winding 110 projected along the magnetic axis 130.

The electrical winding 110 is depicted as having a circular shape. However, the electrical winding 110 may also have a square shape, a rectangular shape, and oval-shaped, or the like.

Figure 2A:
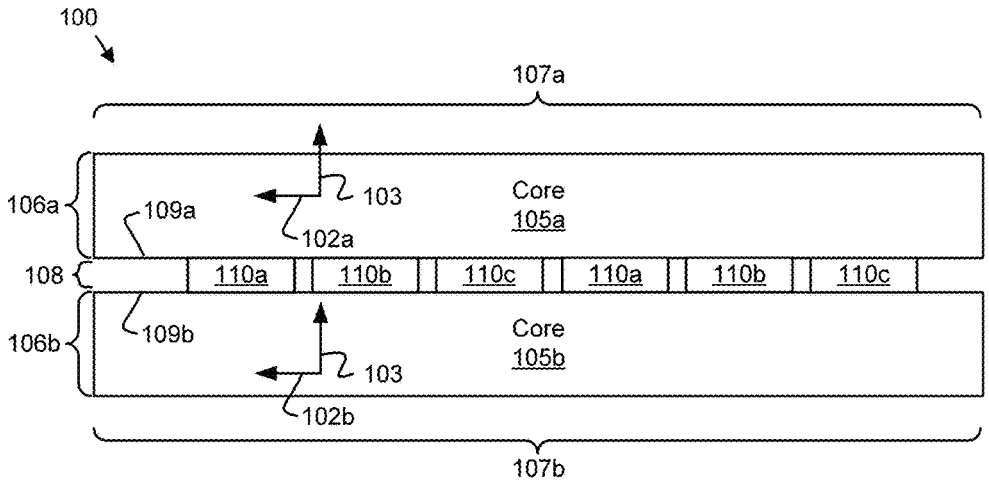
FIG. 2A is a side view drawing illustrating one embodiment of an inductor with three overlapping electrical windings.

FIG. 2A is a side view drawing illustrating one embodiment of an inductor 100 with three overlapping electrical windings 110*a-c*. The inductor 100 includes a first planar core 105*a*, a second planar core 105*b*, and a plurality of electrical windings 110*a-c*. Each planar core 105 has a core thickness 106 and a core width 107. The core thickness 106 may be along a first axis 103 orthogonal to a plane 102 of the planar core 105. For example, the first planar core 105*a* may have a first core thickness 106*a* along the first axis 103 with the first axis 103 orthogonal to the plane 102*a* of the first planar core 105*a*. Similarly, the second planar core 105*b* may have a second core thickness 106*b* along the first axis 103, with the first axis 103 orthogonal to the plane 102*b* of the second planar core 105*b*.

The second planar core 105*b* may be disposed parallel to the first planar core 105*a*, such that the plane 102*a* of the first planar core 105*a* is substantially parallel to the plane 102*b* of the second planar core 105*b*. As used herein, substantially parallel planes are within 15 degrees of parallel.

In one embodiment, a ratio of the core thickness 106 to the core width 107 is in the range of 1:4 to 1:20. In a certain embodiment, the ratio of the core thickness 106 to the core width 107 is in the range of 1:8 to 1:14. Each planar core 105 may be fabricated from a material selected from the group consisting of silicon steel, iron powder, magnetic iron, and ferromagnetic materials. A separation 108 between the first planar core 105*a* and the second planar core 105*b* may be in the range of 0.5 to 20 centimeters (cm). In a certain embodiment, the separation 108 is in the range of 1 to 4 cm. No magnetic teeth may be disposed between the first planar core 105*a* and the second planar core 105*b*.

A plurality of electrical windings 110 are disposed between and adjacent to an inside plane 109*a* of the first planar core 105*a* and an inside plane 109*b* of the second planar core 105*b*. In the depicted embodiment, a first electrical winding 110*a*, a second electrical winding 110*b*, and a third electrical winding 110*c* are disposed between the planar cores 105. The magnetic axis 130 of each electrical winding 110*a-c* is substantially parallel to the first axis 103. In one embodiment, each of the electrical windings 110 has a 120 degree phase difference for the electrical current carried by the electrical winding 110 to each other of the plurality of electrical windings 110. The disposition of the electrical windings 110*a-c* is described in more detail in FIG. 2B.

Figure 2B:
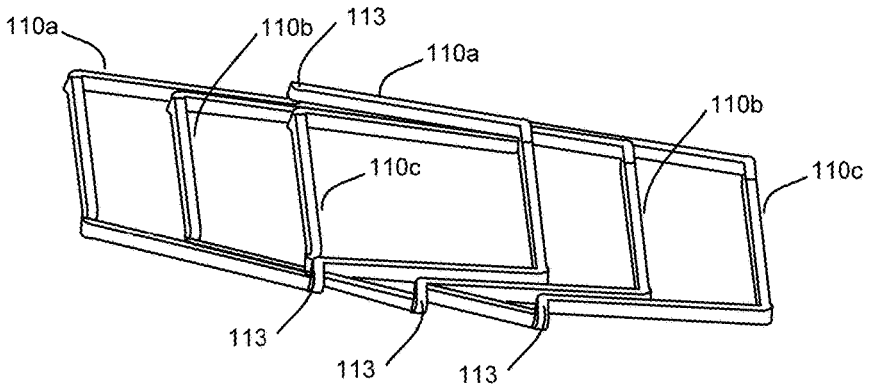
FIG. 2B is a perspective drawing illustrating one embodiment of overlapping electrical windings.

FIG. 2B is a perspective drawing illustrating one embodiment of the overlapping electrical windings 110 of FIG. 2A. In the depicted embodiment, the electrical windings 110 are disposed so that the magnetic axis region 135 of each of the three electrical windings 110*a-c* overlaps a portion of each other magnetic axis region 135 of each other electrical winding 110. In one embodiment, the electrical windings 110 are disposed adjacent to other electrical windings 110 and orthogonal to a plane substantially parallel to the first axis 103. However, one electrical winding 110 may cross another electrical winding 110 with a crossover bend 113. In the depicted embodiment, four crossover bends 113 are shown, while two other crossover bends 113 are obscured by electrical windings 110.

Figure 3A:
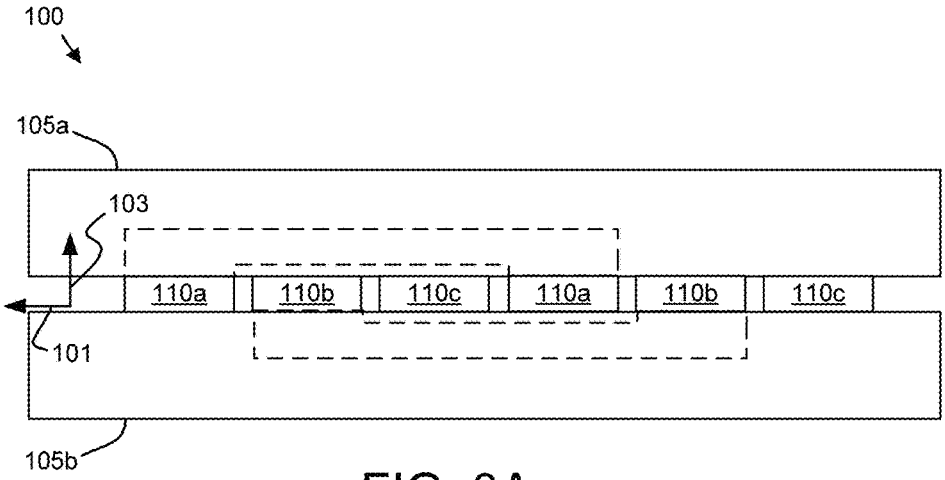
FIG. 3A is a side view drawing illustrating one alternate embodiment of an inductor with three overlapping electrical windings.

FIG. 3A is a side view drawing illustrating one alternate embodiment of an inductor 100 with three overlapping electrical windings 110*a-c*. In the depicted embodiment, the electrical windings 110*a-c* are disposed substantially parallel to a plane 101 orthogonal to the first axis 103. Hidden lines show the first electrical winding 110*a* overlapping the second and third electrical windings 110*b-c* in one direction and the second electrical windings 110*b* overlapping the first and third electrical windings 110*a,c* in another direction. In one embodiment, the first and/or second planar core 105*a-b* may include one or more grooves that receive an electrical winding 110 while the electrical winding 110 overlaps another electrical winding 110. The magnetic region 135 of each electrical winding 110 overlaps a portion of each other magnetic axis region 135 of the other electrical windings 110. No magnetic teeth may be disposed between the first planar core 105*a* and the second planar core 105*b*.

Figure 3B:
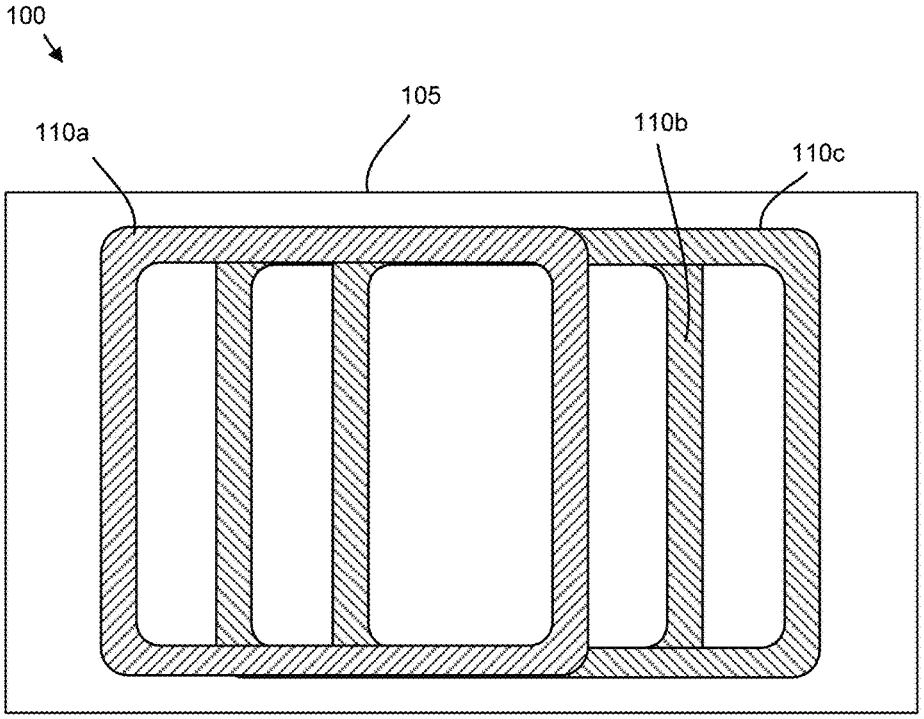
FIG. 3B is a top view drawing illustrating one alternate embodiment of an inductor with three overlapping electrical windings.

FIG. 3B is a top view drawing illustrating one alternate embodiment of an inductor 100 with three overlapping electrical windings 110*a-c* disposed on a planar core 105. For simplicity, the opposing planar core 105 is not shown. The electrical windings 110*a-c* of FIG. 3A are shown with the magnetic region 135 of each electrical winding 110 overlapping a portion of each other magnetic axis region 135 of the other electrical windings 110. In one embodiment, a plane of each electrical winding 110 may be slightly offset along the first axis 103 from a plane of each other electrical winding 110.

Figure 3C:
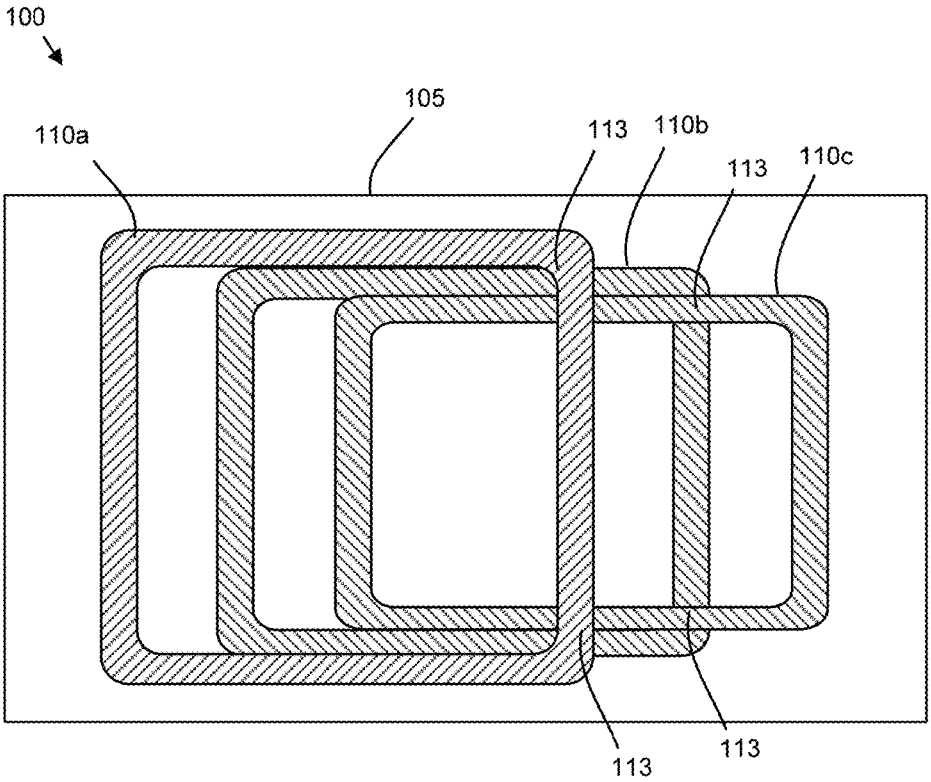
FIG. 3C is a top view drawing illustrating one alternate embodiment of an inductor with three overlapping electrical windings.

FIG. 3C is a top view drawing illustrating one alternate embodiment of an inductor 100 with three overlapping electrical windings 110*a-c* disposed on a planar core 105. For simplicity, the opposing planar core 105 is not shown. The electrical windings 110*a-c* are shown with the magnetic region 135 of each electrical winding 110 overlapping a portion of each other magnetic axis region 135 of the other electrical windings 110. Each electrical winding 110 may be coplanar with each other electrical winding 110 except at crossover bends 113.

Figure 4A:
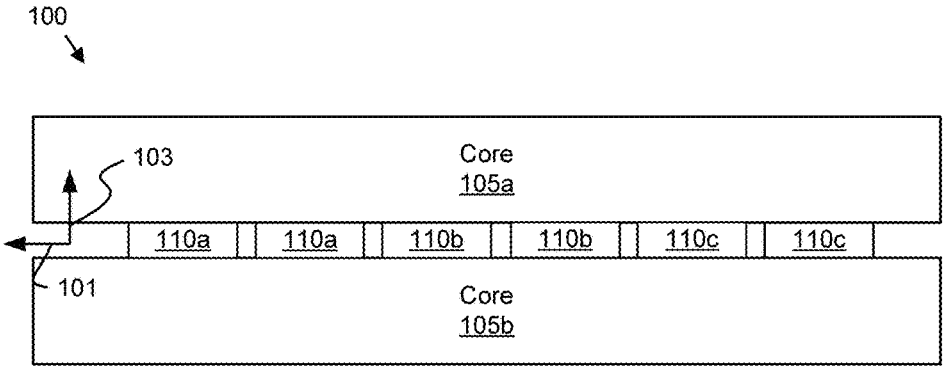
FIG. 4A is a side view drawing illustrating one embodiment of an inductor with three side-by-side electrical windings.

FIG. 4A is a side view drawing illustrating one embodiment of an inductor 100 with three side-by-side electrical windings 110*a-c*. In the depicted embodiment, the electrical windings 110*a-c* are disposed substantially parallel to a plane 101 orthogonal to the first axis 103. No magnetic access region 135 of the electrical windings 110 overlaps any other magnetic axis region 135 of the other electrical windings 110. No magnetic teeth may be disposed between the first planar core 105*a* and the second planar core 105*b*.

Figure 4B:
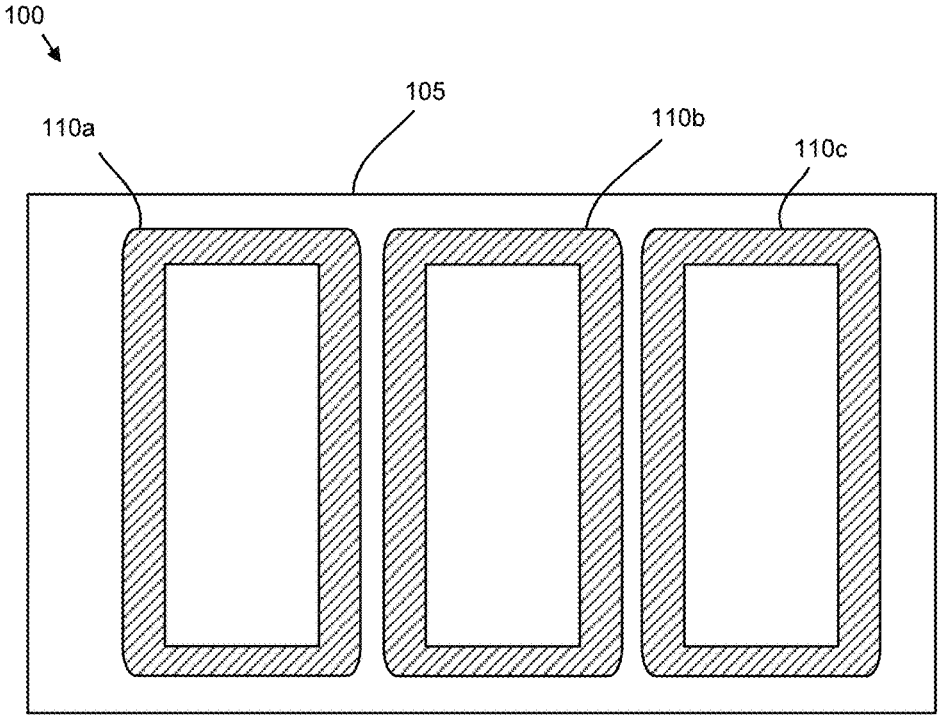
FIG. 4B is a top view drawing illustrating one embodiment of an inductor with three side-by-side electrical windings.

FIG. 4B is a top view drawing illustrating one embodiment of an inductor 100 with three side-by-side electrical windings 110*a-c*. The three electrical windings 110*a-c* of FIG. 4A are depicted disposed side-by-side and coplanar on a planar core 105. For simplicity, the opposing planar core 105 is not shown. No magnetic access region 135 of the electrical windings 110 overlaps any other magnetic axis region 135 of the other electrical windings 110.

Figure 4C:
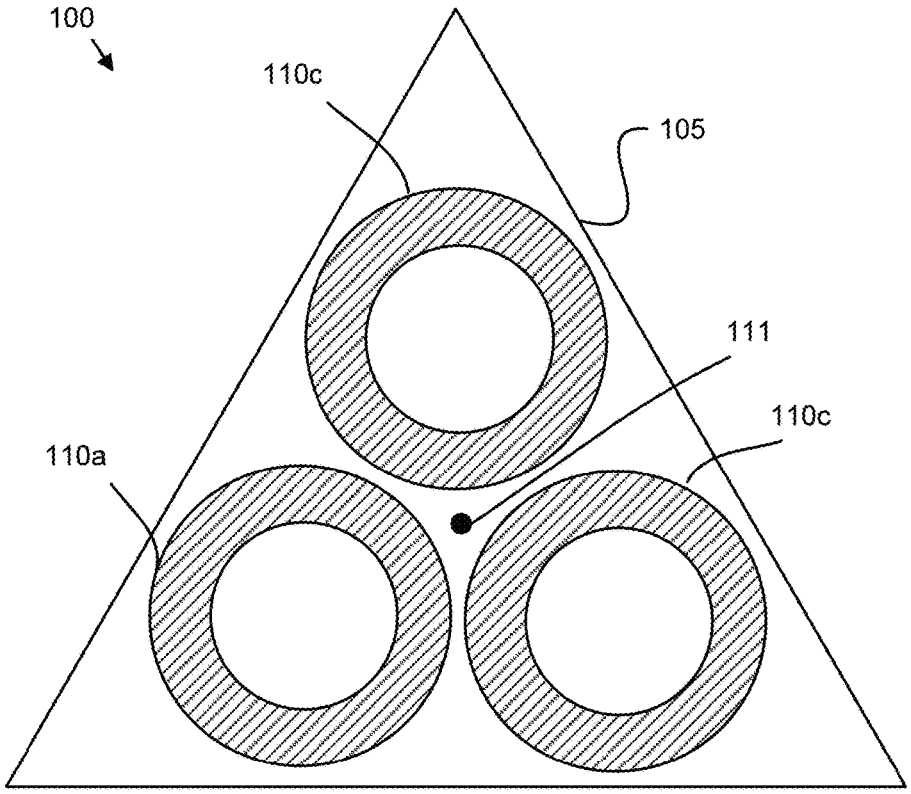
FIG. 4C is a top view drawing illustrating one alternate embodiment of an inductor with three side-by-side electrical windings.

FIG. 4C is a top view drawing illustrating one alternate embodiment of an inductor 100 with three side-by-side electrical windings 110*a-c* disposed on a planar core 105. For simplicity, the opposing planar core 105 is not shown. In the depicted embodiment, the planar cores 105 have a shape selected from the group consisting of a triangular shape, a square shape, a pentagonal shape, a hexagonal shape, an octagonal shape, and a circular shape. Alternatively, the shape may be selected from the group consisting of a triangular shape and a circular shape. In the depicted embodiment, the shape is a triangular shape. The shape may be about a central axis 111. The electrical windings 110 may be coplanar. No magnetic teeth may be disposed between the first planar core 105*a* and the second planar core 105*b*. In one embodiment, the plurality of electrical windings 110*a-c* are disposed around the central axis 111. Each of the plurality of electrical windings 110 may have a 120 degree phase difference to each other of the plurality of electrical windings 110.

Figure 4D:
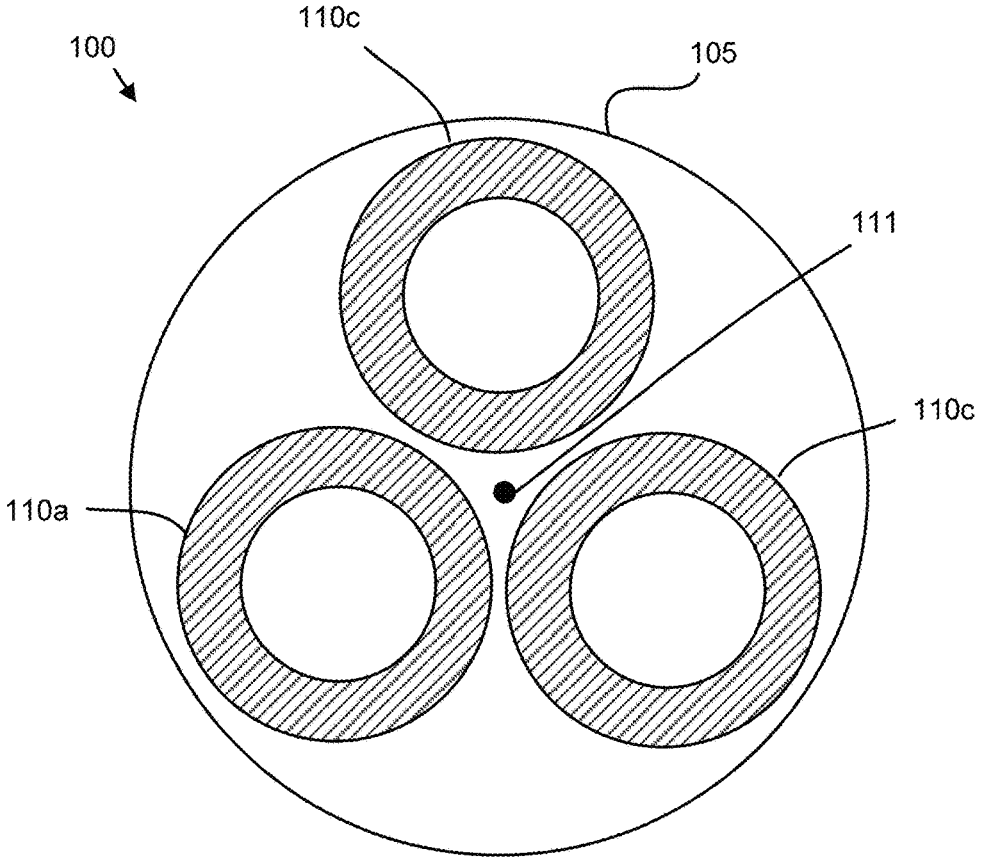
FIG. 4D is a top view drawing illustrating one alternate embodiment of an inductor with three side-by-side electrical windings.

FIG. 4D is a top view drawing illustrating one alternate embodiment of an inductor 100 with three side-by-side electrical winding 110*a-c* disposed on a planar core 105. For simplicity, the opposing planar core 105 is not shown. In the depicted embodiment, the shape of the planar cores is a circular shape. No magnetic teeth may be disposed between the first planar core 105*a* and the second planar core 105*b*. The electrical windings 110 may be coplanar.

Figure 5A:
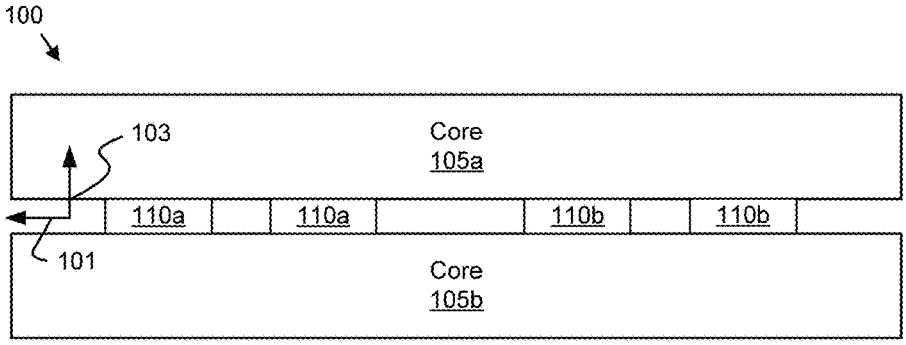
FIG. 5A is a side view drawing illustrating one embodiment of an inductor with two side-by-side electrical windings.

FIG. 5A is a side view drawing illustrating one embodiment of an inductor 100 with two side-by-side electrical windings 110*a-b*. In the depicted embodiment, the electrical windings 110*a-b* are disposed substantially parallel to a plane 101 orthogonal to the first axis 103. In one embodiment, no magnetic teeth are disposed between the first planar core 105*a* and the second planar core 105*b*.

Figure 5B:
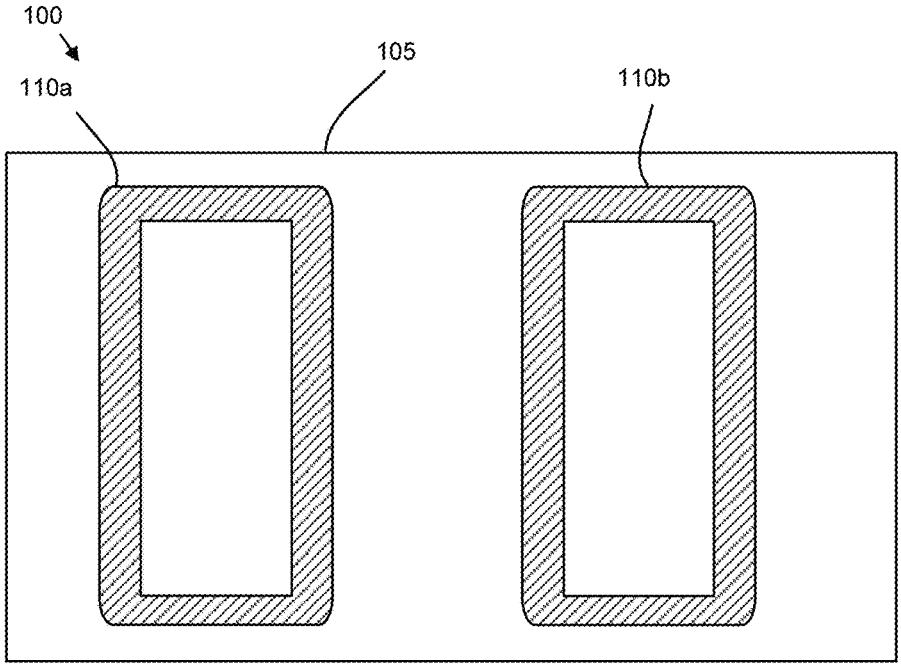
FIG. 5B is a top view drawing illustrating one embodiment of an inductor with two side-by-side electrical windings.

FIG. 5B is a top view drawing illustrating one embodiment of an inductor 100 with two side-by-side electrical windings 110*a-b*. The electrical windings 110*a-b* of FIG. 5A are shown disposed on a planar core 105. For simplicity, the opposing planar core 105 is not shown. The electrical windings 110 may be coplanar. No magnetic access region 135 of the electrical windings 110 overlaps any other magnetic axis region 135 of the other electrical windings 110.

Figure 6A:
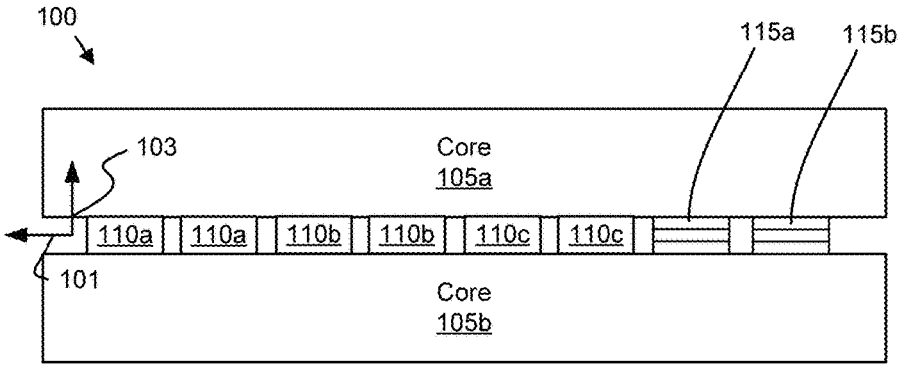
FIG. 6A is a side view drawing illustrating one embodiment of an inductor with common mode windings.

FIG. 6A is a side view drawing illustrating one embodiment of an inductor 100 with common mode windings 115. In the depicted embodiment, three side-by-side electrical windings 110*a-c* are shown disposed between the planar cores 105*a-b*. The electrical windings 110*a-c* may be differential mode electrical windings 110*a-c*. In addition, one or more common mode windings 115 are disposed between the planar cores 105*a-b* and adjacent to a third electrical winding 110*c*. In the depicted embodiment, the electrical windings 110*a-b* and a stack of common mode windings 115 are disposed substantially parallel to a plane 101 orthogonal to the first axis 103. In one embodiment, no magnetic teeth are disposed between the planar cores 105*a-b*.

Figure 6B:
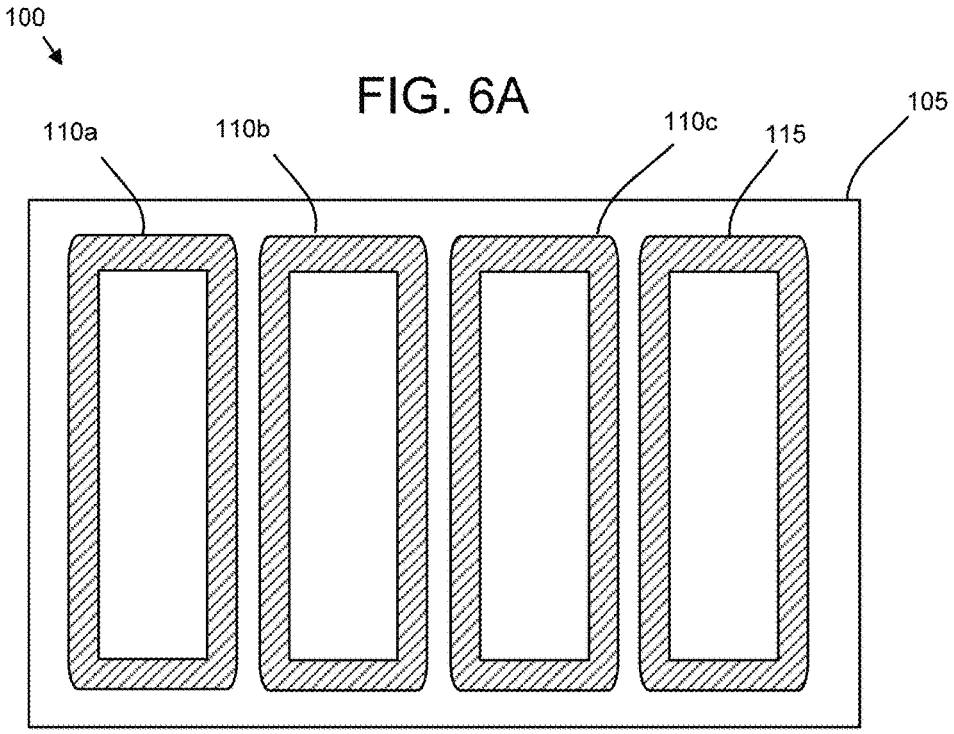
FIG. 6B is a top view drawing illustrating one embodiment of an inductor with common mode windings.

FIG. 6B is a top view drawing illustrating one embodiment of an inductor 100 with common mode windings 115. The electrical windings 110*a-c* and the common mode windings 115 of FIG. 6A are shown disposed on a planar core 105. For simplicity, the opposing planar core 105 is not shown. The magnetic axis regions 135 of the electrical windings 110*a-c* and the common mode windings 115 do not overlap.

A plurality of common mode windings 115 may be disposed in a vertical stack along the first axis 103. The magnetic access region 135 of each common mode winding 115 may overlap a magnetic access region 135 of each other common mode winding 115. In one embodiment, each of the plurality of electrical windings 110*a-c* is electrically connected in series to one corresponding common mode winding 115. In the depicted embodiment, the plurality of common mode windings 115 are disposed adjacent to only one of the plurality of electrical windings 110*a-c*. The electrical windings 110 and the common mode windings 115 may be coplanar.

Figure 6C:
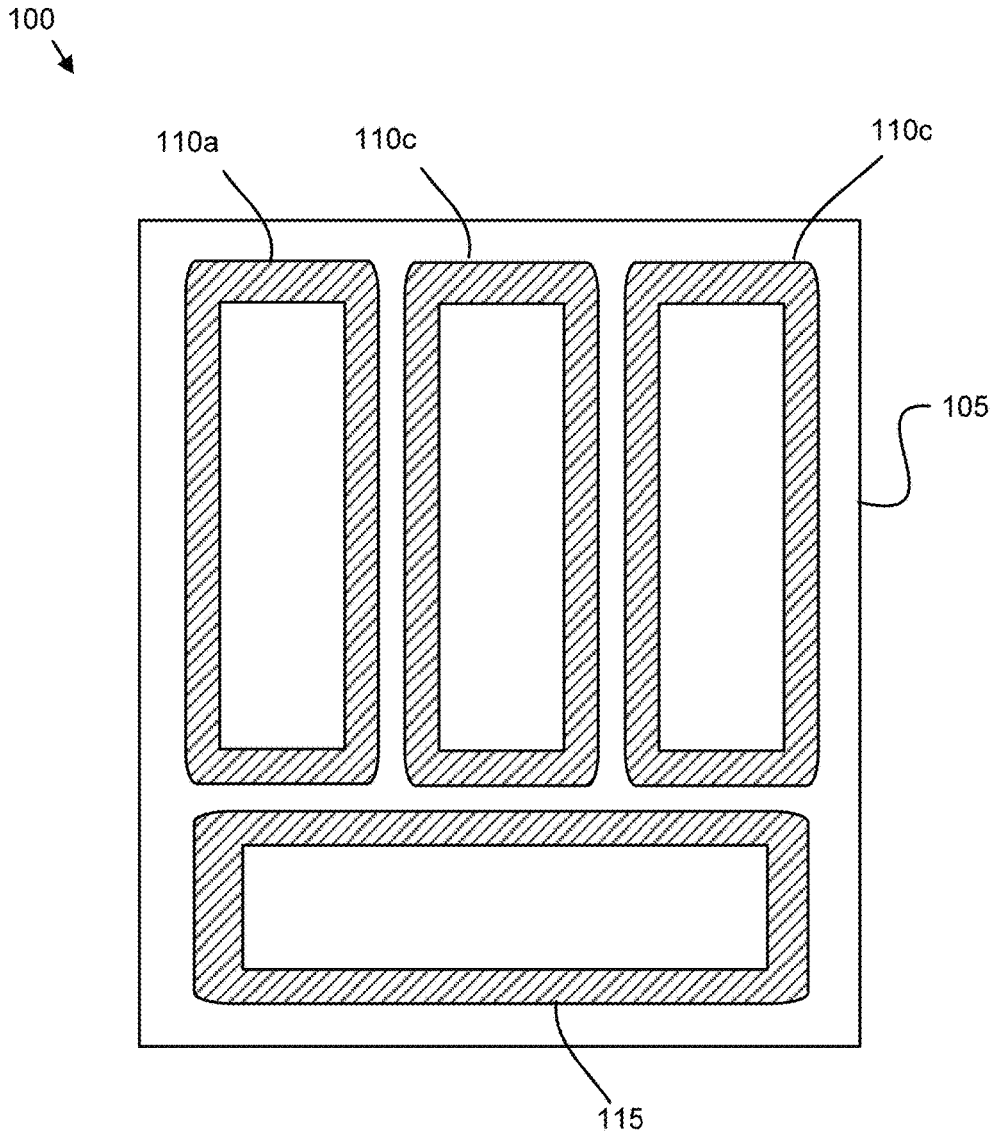
FIG. 6C is a top view drawing illustrating one alternate embodiment of an inductor with common mode windings.

FIG. 6C is a top view drawing illustrating one alternate embodiment of an inductor 100 with common mode windings 115. The electrical windings 110*a-c* and the common mode windings 115 are shown disposed on a planar core 105. For simplicity, the opposing planar core 105 is not shown. The magnetic axis regions 135 of the electrical windings 110*a-c* and the common mode windings 115 do not overlap. The electrical windings 110 and the common mode windings 115 may be coplanar.

A plurality of common mode windings 115 may be disposed in a vertical stack along the first axis 103. The magnetic access region 135 of each common mode winding 115 may overlap a magnetic access region 135 of each other common mode winding 115. In one embodiment, each of the plurality of electrical windings 110*a-c* is electrically connected in series to one corresponding common mode winding 115. In the depicted embodiment, the plurality of common mode windings 115 are disposed adjacent to each of the plurality of electrical windings 110*a-c*.

Figure 6D:
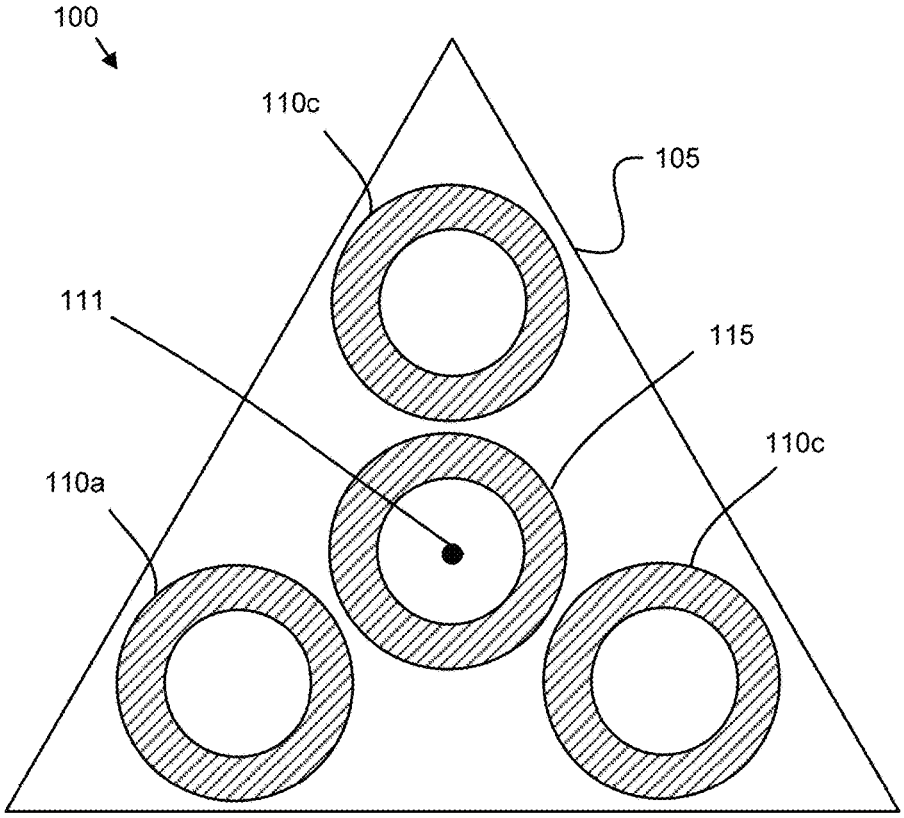
FIG. 6D is a top view drawing illustrating one alternate embodiment of an inductor with common mode windings.

FIG. 6D is a top view drawing illustrating one alternate embodiment of an inductor 100 with common mode windings 115. The electrical windings 110*a-c* and the common mode windings 115 are shown disposed on a planar core 105. For simplicity, the opposing planar core 105 is not shown. The magnetic axis regions 135 of the electrical windings 110*a-c* and the common mode windings 115 do not overlap. In the depicted embodiment, the planar core 105 as a triangular shape.

The common mode windings 115 are disposed about the central axis 111. A plurality of common mode windings 115 may be disposed in a vertical stack along the first axis 103, which is orthogonal to the drawing. Each of the electrical windings 110*a-c* may be disposed adjacent to the common mode windings 115. In one embodiment, each of the plurality of electrical windings 110*a-c* is electrically connected in series to one corresponding common mode winding 115. Each of the plurality of electrical windings 110*a-c* may have a 120 degree phase difference to each other of the plurality of electrical windings 110*a-c*.

Figure 6E:
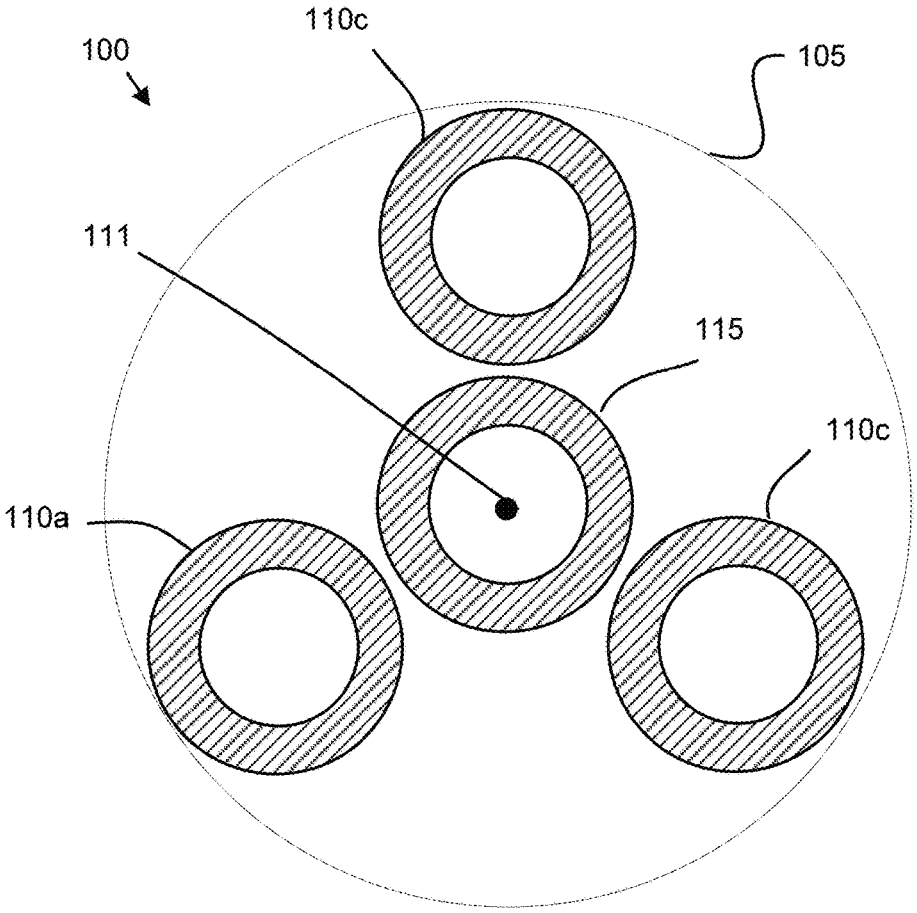
FIG. 6E is a top view drawing illustrating one alternate embodiment of an inductor with common mode windings.

FIG. 6E is a top view drawing illustrating one alternate embodiment of an inductor 100 with common mode windings 115. The electrical windings 110*a-c* and the common mode windings 115 are shown disposed on a planar core 105. For simplicity, the opposing planar core 105 is not shown. The magnetic axis regions 135 of the electrical windings 110*a-c* and the common mode windings 115 do not overlap. In the depicted embodiment, the planar core 105 as a circular shape.

The common windings 115 are disposed about the central axis 111. A plurality of common mode windings 115 may be disposed in a vertical stack along the first axis 103, which is orthogonal to the drawing. Each of the electrical windings 110*a-c* is disposed adjacent to the common mode windings 115. In one embodiment, each of the plurality of electrical windings 110*a-c* is electrically connected in series to one corresponding common mode winding 115. Each of the plurality of electrical windings 110*a-c* may have a 120 degree phase difference to each other of the plurality of electrical windings 110*a-c*.

Figure 6F:
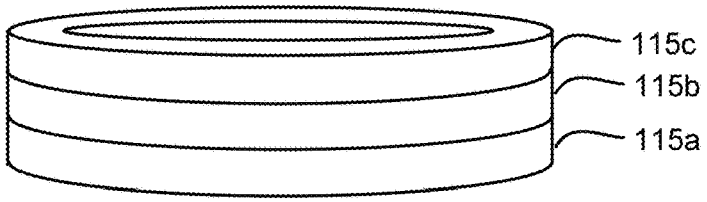
FIG. 6F is a perspective drawing illustrating one embodiment of common mode windings.
Figure 6G:
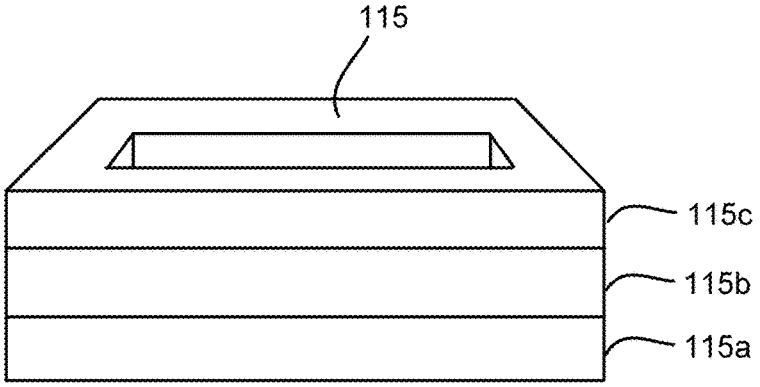
FIG. 6G is a perspective drawing illustrating one alternate embodiment of common mode windings.

FIG. 6F is a perspective drawing illustrating one embodiment of common mode windings 115*a-c*. In the depicted embodiment, the common mode windings 115*a-c* comprise a first common mode winding 115*a*, a second common mode winding 115*b*, and a third common mode winding 115*c*. The common mode windings 115*a-c* are shown with the circular shape. However, the common mode windings 115*a-c* maybe organized in any shape. FIG. 6G is a perspective drawing illustrating one alternate embodiment of the common mode windings 115*a-c* organized in a square shape.

Figure 6H:
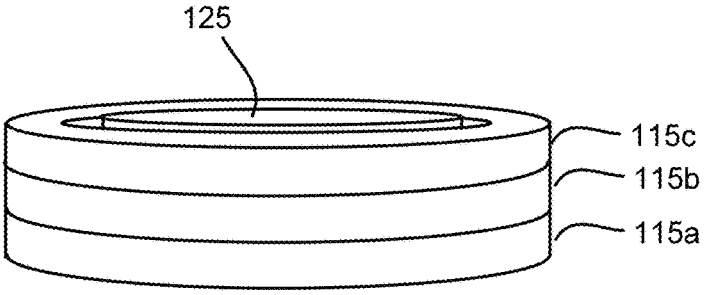
FIG. 6H is a perspective drawing illustrating one embodiment of common mode windings with a magnetic tooth.

FIG. 6H is a perspective drawing illustrating one embodiment of common mode windings 115*a-c* with a tooth 125. The tooth 125 may be a magnetic tooth 125. The tooth may be disposed inside each common mode winding 115*a-c* and be disposed between the first planar core 105*a* and the second planar core 105*b*. The tooth 125 may concentrate magnetic flux between the first planar core 105*a* and the second planar core 105*b*.

Figure 7:
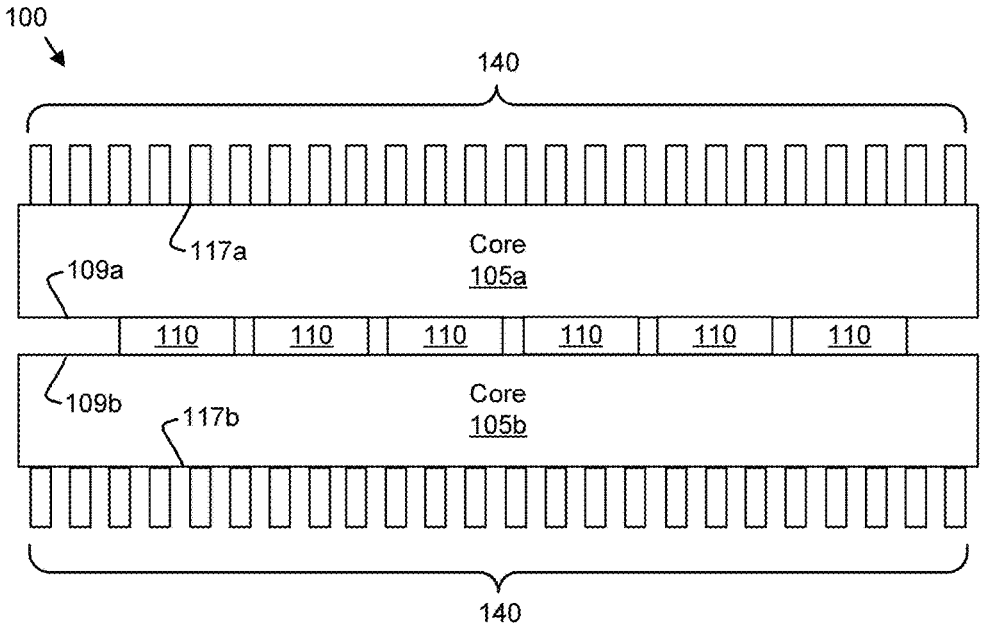
FIG. 7 is a side view drawing illustrating one embodiment of an inductor with cooling fins.

FIG. 7 is a side view drawing illustrating one embodiment of an inductor 100 with cooling fins 140. The cooling fins 140 may be a series of parallel ridges, an array of fingers, or the like. The cooling fins 140 may be disposed on an outer plane 117*a-b* of the first planar core 105*a* and the second planar core 105*b*. Because the planar cores 105 direct the magnetic flux from the electrical windings 110 as will be shown hereafter in FIGS. 9A-D, the cooling fins 140 may be added without substantially reducing the magnetic flux. As a result, the inductor 100 may be more effectively cooled, reducing the material cost and the operation cost of an electrical device employing the inductor 100.

Figure 8:
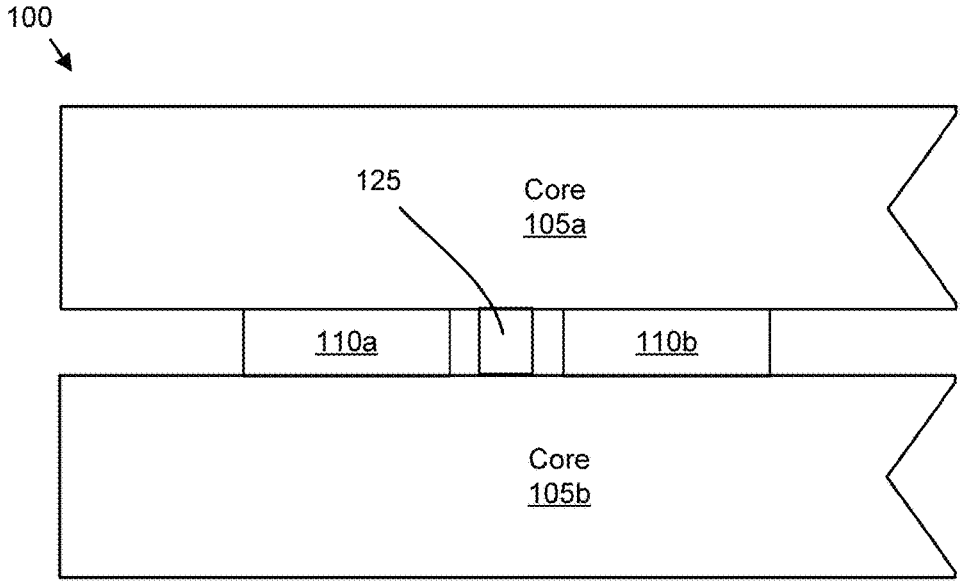
FIG. 8 is a side view drawing illustrating one embodiment of an inductor with a magnetic tooth.

FIG. 8 is a side view drawing illustrating one embodiment of an inductor 100 with a tooth 125. The tooth 125 may be a magnetic tooth 125. The tooth 125 is disposed between the first planar core 105*a* and the second planar core 105*b*. The tooth 125 may concentrate magnetic flux between the first planar core 105*a* and the second planar core 105*b*.

Figure 9A:
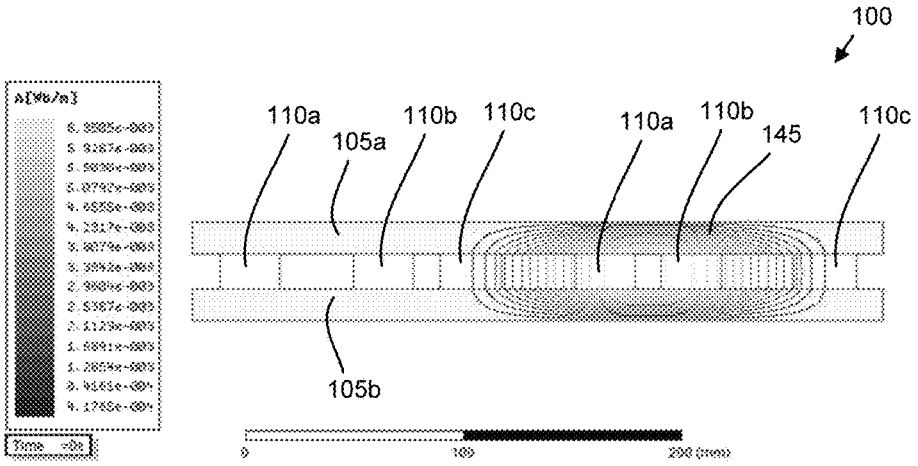
FIG. 9A is a side view drawing of simulated flux in an inductor with differential mode excitation.

FIG. 9A is a side view drawing of simulated magnetic flux 145 in an inductor 100 with differential mode excitation. The inductor 100 includes three differential mode electrical windings 110*a-c*. In the depicted embodiment, the simulated magnetic flux 145 densities are shown for portions of a first electrical winding 110*a* and a second electrical winding 110*b* in response to differential mode excitation in the first electrical winding 110*a* and the second electrical winding 110*b*.

Figure 9B:
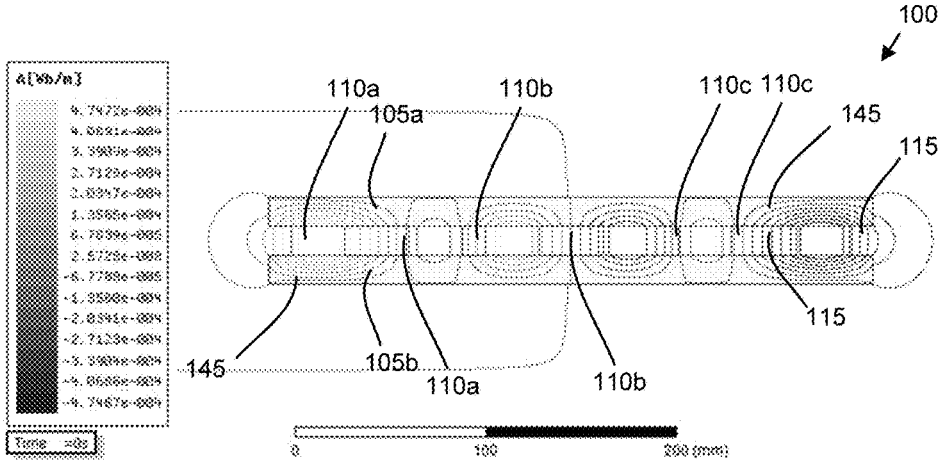
FIG. 9B is a side view drawing of simulated flux in an inductor with common mode excitation.

FIG. 9B is a side view drawing of simulated magnetic flux 145 in an inductor 100 with common mode excitation in the common mode windings 115. The inductor 100 includes three side-by-side differential mode electrical windings 110*a-c* and common mode windings 115. The resulting simulated magnetic flux 145 is shown for excitation of the common mode windings 115.

Figure 9C:
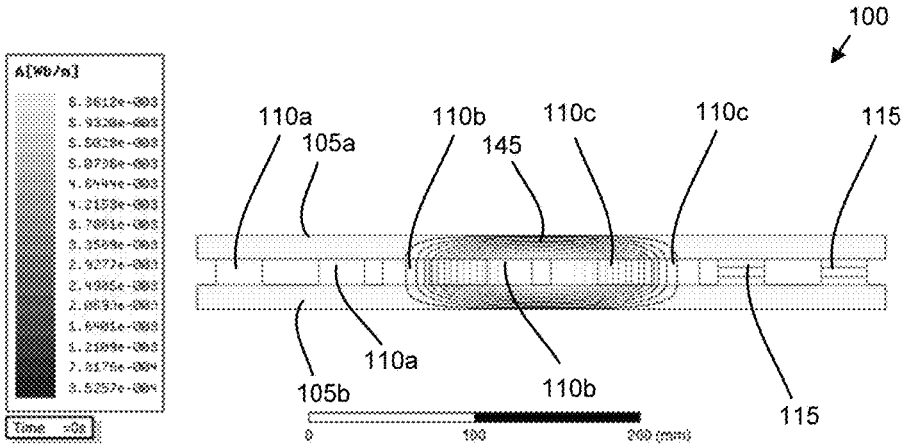
FIG. 9C is a side view drawing of simulated flux in an inductor with common mode windings and differential mode excitation.

FIG. 9C is a side view drawing of simulated magnetic flux 145 in an inductor 100 with common mode windings and differential mode excitation. The inductor 100 includes three side-by-side differential mode electrical windings 110*a-c* and common mode windings 115. The resulting simulated magnetic flux 145 is shown for excitation of the differential mode electrical windings 110*a-c*.

Figure 9D:
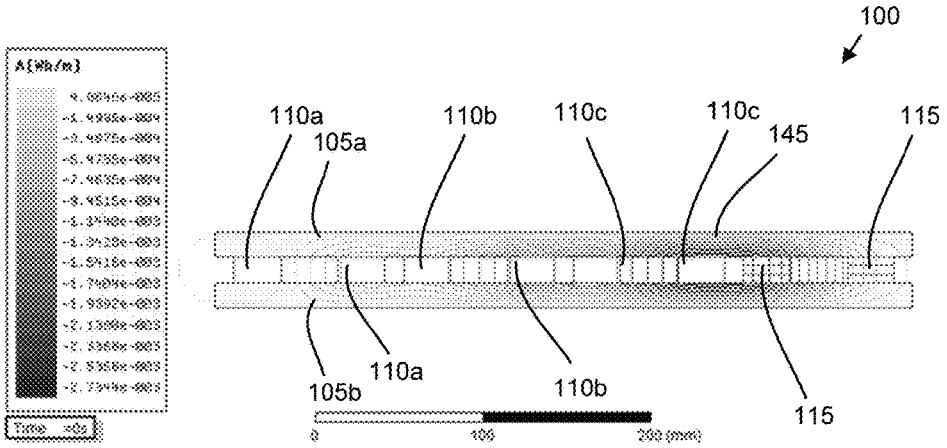
FIG. 9D is a side view drawing of simulated flux in an inductor with common mode windings and common mode excitation.

FIG. 9D is a side view drawing of simulated magnetic flux 145 in an inductor 100 with common mode windings 115 and common mode excitation. The inductor 100 includes three side-by-side differential mode electrical windings 110*a-c* and common mode windings 115. The resulting simulated magnetic flux 145 is shown for excitation of the common mode windings 115.

In each of the simulations of FIGS. 9A-D, the simulated magnetic flux 145 is effectively concentrated within the planar cores 105*a-b*, indicating reduced leakage of the magnetic flux by the embodiments.

In one embodiment, the flux density in the first planar core and the second planar core is less than 1 Tesla for a magnetic iron planar core and an iron powder planar core, and less than 2.03 Tesla for a silicon steel planar core. In a certain embodiment, the flux density in the first planar core and the second planar core is less than 1.8 Tesla for a magnetic iron planar core and an iron powder planar core, and less than 2.5 Tesla for a silicon steel planar core.

Figure 10A:
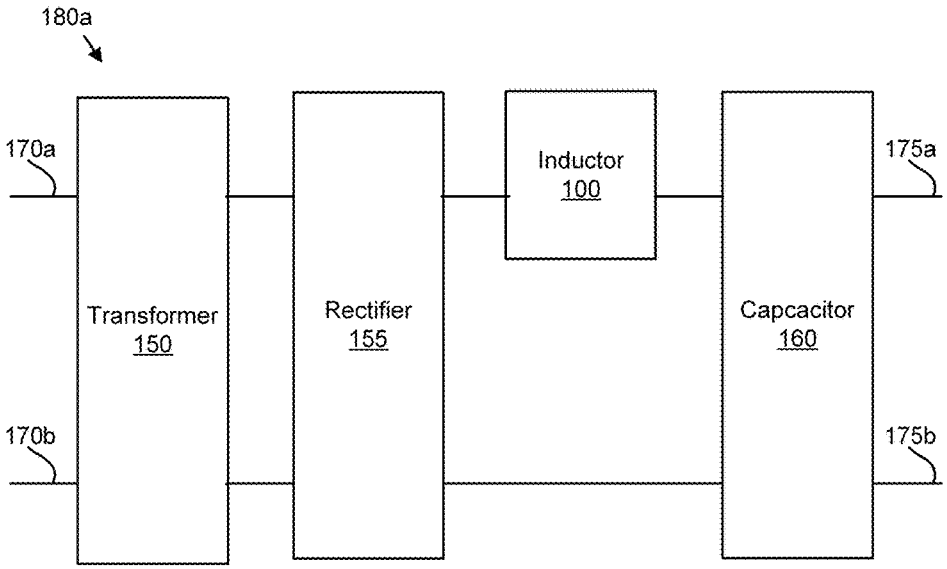
FIG. 10A is a schematic block diagram illustrating one embodiment of a power supply.

FIG. 10A is a schematic block diagram illustrating one embodiment of a power supply 180*a*. In the depicted embodiment, the power supply 180*a* includes inputs 170, a transformer 150, a rectifier 155, an inductor 100, a plurality of capacitors 160, and outputs 175. The power supply 180*a* may receive alternating current power at the inputs 170 and provide direct current power at the outputs 175. In one embodiment, each of the electrical windings 110 of the inductor 100 is connected to one corresponding capacitor 160 of the plurality of capacitors 160.

Figure 10B:
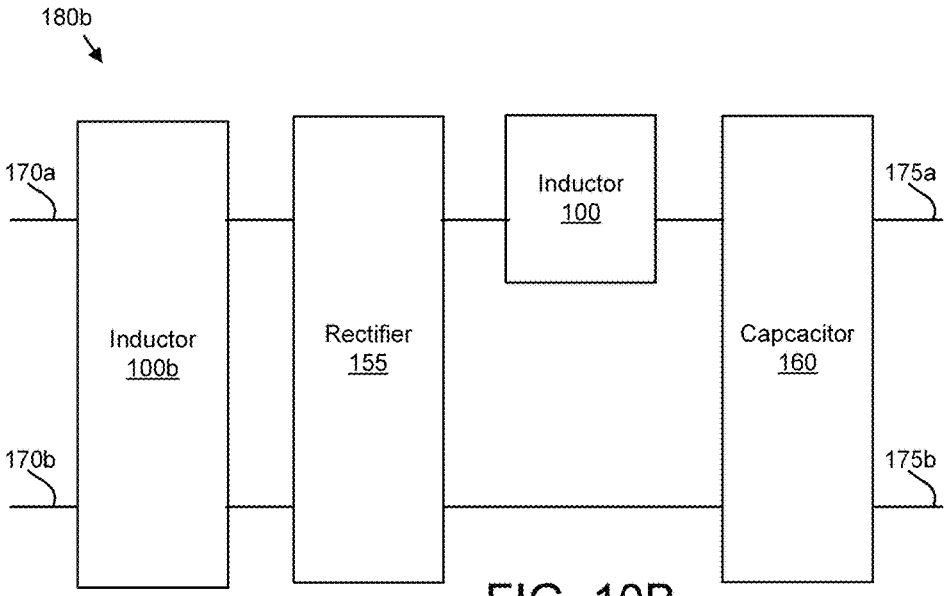
FIG. 10B is a schematic block diagram illustrating one alternate embodiment of a power supply.

FIG. 10B is a schematic block diagram illustrating one alternate embodiment of a power supply 180*b*. The power supply 180*b* includes the inputs 170, the rectifier 155, the inductor 100, the plurality of capacitors 160, and the outputs 175 of FIG. 10A. In addition, an embodiment of the inductor 100*b* may be used in place of the transformer 150.

Figure 11:
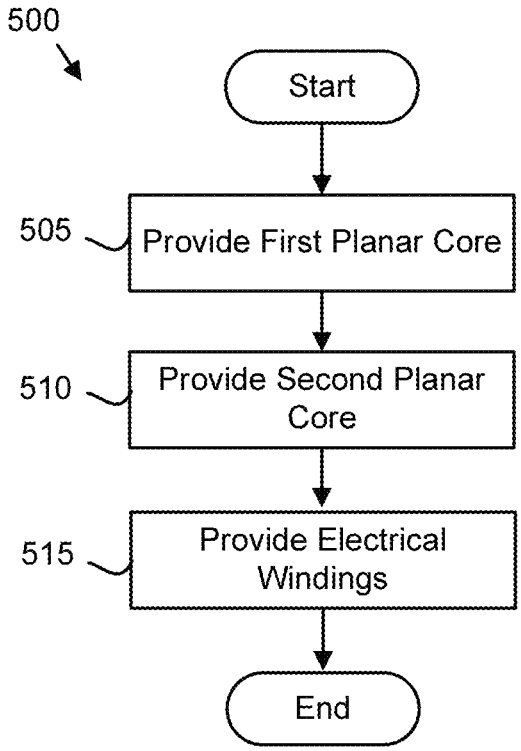
FIG. 11 is a schematic flow chart diagram illustrating one embodiment of an inductor provision method.

FIG. 11 is a schematic flow chart diagram illustrating one embodiment of an inductor provision method 500. The method 500 may provide 505 a first planar core 105*a* with a first core thickness 106*a* along a first axis 103 that is orthogonal to a plane 102*a* of the first planar core 105*a*. In addition, the method 500 may provide 510 a second planar core 105*b* disposed parallel to the first planar core 105*a* with a second core thickness 106*a* along the first axis 103. The method 500 further provides 515 a plurality of electrical windings 110 that comprise insulated electrical wires and are disposed between and adjacent to an inside plane 109*a* of the first planar core 105*a* and an inside plane 109*b* of the second planar core 105*b*. In one embodiment, no magnetic teeth 125 are disposed between the first planar core 105*a* and the second planar core 105*b* and the first axis 103 is parallel to a magnetic axis 130 of each electrical winding 110.

The embodiments employ the planar cores 105 to concentrate the magnetic flux from the electrical windings 110 as illustrated in FIGS. 9A-D. As a result, the leakage of magnetic flux and electromagnetic radiation is reduced. In addition, the embodiments support the use of cooling fins 140, so that the inductor 100 may be cooled more efficiently. As a result, the inductor 100 requires less volume within a chassis, reducing the cost of an electrical device. In addition, because the inductor 100 may be cooled more efficiently, the operating cost of the electrical device may be reduced.

The described examples and embodiments are to be considered in all respects only as illustrative and not restrictive. This written description uses examples and embodiments to disclose the invention, including best mode, and also to enable any person skilled in the art to practice the invention, including making and using any devices or systems and performing any incorporated methods. The examples and embodiments may be practiced in other specific forms. The patentable scope of this invention is defined by the claims and may include other examples that occur to those skilled in the art. Such other examples are intended to be within the claims if they have structural elements that do not differ from the literal language of the claims, or if they include equivalent structural element with insubstantial differences from the literal languages of the claims.

What is claimed is:

1. An inductor comprising:

a first planar core with a first core thickness along a first axis orthogonal to a plane of the first planar core;

a second planar core disposed parallel to the first planar core with a second core thickness along the first axis; and three electrical windings comprising insulated electrical wires and disposed between and adjacent to an inside plane of the first planar core and an inside plane of the second planar core so that so that a magnetic axis region of each of the three electrical windings overlaps a portion of each other magnetic axis region of each other electrical winding, wherein the electrical windings are disposed adjacent to other electrical windings and orthogonal to a plane substantially parallel to a first axis and each electrical winding crosses at least one other electrical winding with a crossover bend, wherein no magnetic teeth are disposed between the first planar core and the second planar core and the first axis is parallel to a magnetic axis of each electrical winding.

2. The inductor of claim 1, the inductor further comprising a plurality of common mode windings, wherein each of the plurality of electrical windings is electrically connected in series to one corresponding common mode winding, each common mode winding is disposed between the first planar core and the second planar core, and a magnetic axis region of each common mode winding overlaps a magnetic axis region of each other common mode winding.

3. The inductor of claim 2, wherein the plurality of common mode windings is disposed adjacent to only one of the plurality of electrical windings.

4. The inductor of claim 2, wherein the plurality of common mode windings are disposed adjacent to each of the plurality of electrical windings.

5. The inductor of claim 2, the inductor further comprising at least one tooth disposed inside each common mode winding and between the first planar core and the second planar core.

6. The inductor of claim 1, wherein the three electrical windings are disposed around a central axis and each of the three electrical windings has a 120 degree phase difference to each other of the three electrical windings.

7. The inductor of claim 1, wherein the first planar core and the second planar core have a shape about a central axis selected from the group consisting of a triangular shape and a circular shape.

8. The inductor of claim 1, wherein the plurality of electrical windings comprise three electrical windings and no magnetic axis region of the three electrical windings overlaps any other magnetic axis region of the other electrical windings.

9. The inductor of claim 1, wherein the plurality of electrical windings comprise two electrical windings and a magnetic axis region of a first electrical winding does not overlap a magnetic axis region of a second electrical winding.

10. The inductor of claim 1, wherein each planar core is fabricated from a material selected from the group consisting of silicon steel, iron powder, magnetic iron, and ferromagnetic materials.

11. The inductor of claim 1, wherein each planar core further comprises one or more cooling fins disposed on an outside plane of the planar core.

12. The inductor of claim 1, wherein each of the three electrical windings does not overlap a second portion of each other magnetic axis region of each other electrical winding, the three electrical windings are coplanar between the first planar core and the second planar core, and each crossover bend leaves a plane of the electrical windings, passes around the other electrical windings, and returns to the plane of the electrical windings.

13. A power supply comprising:

a plurality of capacitors;

a first planar core with a first core thickness along a first axis orthogonal to a plane of the first planar core;

a second planar core disposed parallel to the first planar core with a second core thickness along the first axis; and three electrical windings each electrically connected to a capacitor of the plurality of capacitors, comprising insulated electrical wires, and disposed between and adjacent to an inside plane of the first planar core and an inside plane of the second planar core so that so that a magnetic axis region of each of the three electrical windings overlaps a portion of each other magnetic axis region of each other electrical winding, wherein the electrical windings are disposed adjacent to other electrical windings and orthogonal to a plane substantially parallel to a first axis and each electrical winding crosses at least one other electrical winding with a crossover bend, wherein no magnetic teeth are disposed between the first planar core and the second planar core and the first axis is parallel to a magnetic axis of each electrical winding.

14. The power supply of claim 13, the inductor further comprising a plurality of common mode windings, wherein each of the plurality of electrical windings is electrically connected in series to one corresponding common mode winding, each common mode winding is disposed between the first planar core and the second planar core, and a magnetic axis region of each common mode winding overlaps a magnetic axis region of each other common mode winding.

15. The power supply of claim 14, wherein the plurality of common mode windings are disposed adjacent to only one of the plurality of electrical windings.

16. The power supply of claim 14, wherein the plurality of common mode windings are disposed adjacent to each of the plurality of electrical windings.

17. The power supply of claim 14, the inductor further comprising at least one tooth disposed inside each common mode winding and between the first planar core and the second planar core.

18. The power supply of claim 13, wherein the three electrical windings are disposed at around a central axis and each of the three electrical windings has a 120 degree phase difference to each other of the three electrical windings.

19. The power supply of claim 13, wherein the first planar core and the second planar core have a shape about a central axis selected from the group consisting of a triangular shape and a circular shape.

20. The power supply of claim 13, wherein each of the three electrical windings does not overlap a second portion of each other magnetic axis region of each other electrical winding, the three electrical windings are coplanar between the first planar core and the second planar core, and each crossover bend leaves a plane of the electrical windings, passes around the other electrical windings, and returns to the plane of the electrical windings.

* * * * *